United States Patent [19]

Kapur et al.

[11] Patent Number: 5,037,283

[45] Date of Patent: Aug. 6, 1991

[54] VANE TYPE POSITIVE DISPLACEMENT PUMP HAVING MULTIPLE PUMP UNITS

[75] Inventors: Desh K. Kapur, Elyria; Duane C. Johnson, West Chester, both of Ohio

[73] Assignee: Lear Romec Corp., Elyria, Ohio

[21] Appl. No.: 467,786

[22] Filed: Jan. 19, 1990

[51] Int. Cl.[5] ..... F04C 2/344; F04C 11/00

[52] U.S. Cl. ..... 418/133; 418/178; 418/213; 418/255

[58] Field of Search ..... 418/178, 212, 213, 255, 418/133, 135

[56] References Cited

U.S. PATENT DOCUMENTS

| | | | |
|---|---|---|---|
| 949,638 | 2/1910 | Stormer | 418/212 |
| 1,165,852 | 12/1915 | Darlington | 418/255 |
| 2,293,119 | 8/1942 | Davis | 418/255 |
| 2,676,545 | 4/1954 | Barr | 418/255 |
| 4,619,594 | 10/1986 | Moir | 418/255 |

FOREIGN PATENT DOCUMENTS

| | | | |
|---|---|---|---|
| 552792 | 1/1923 | France | 418/213 |

*Primary Examiner*—John J. Vrablik

*Attorney, Agent, or Firm*—Renner, Otto, Boisselle & Sklar

[57] ABSTRACT

Vane type positive displacement pump includes three separate vane type pump units on a single shaft, with spacers between the middle pump unit and both end pump units for axially positioning the pump vanes for the middle pump unit at both ends and axially positioning the pump vanes for the two end pump units at one end. The shaft has reduced diameter journal portions adjacent opposite ends of the barrel portion for the middle pump unit on which the spacers are mounted. Also, the outer diameter of the barrel portions for the two end pump units corresponds to the outer diameter of the journal portions for the spacers. At the other end of the end pump units are end bearings for axially positioning the vanes for the end pump units at such other ends.

32 Claims, 2 Drawing Sheets

VANE TYPE POSITIVE DISPLACEMENT PUMP HAVING MULTIPLE PUMP UNITS

FIELD OF THE INVENTION

This invention relates generally, as indicated, to a vane type positive displacement pump (or motor), and, more particularly, to a single shaft, multiple pump unit vane type positive displacement pump (or motor) which does not compromise the efficiency of the pump units or the mechanical integrity of the overall pump design.

BACKGROUND OF THE INVENTION

Vane type positive displacement pumps and motors use mechanical power to compress a fluid when operating as a pump and compressed fluid as a power source when operating as a motor. To avoid complication of description, these devices will be described herein as pumps, it being understood that the reverse operation as a motor is equally possible.

Typically these pumps comprise a housing containing a liner with a bore and a pair of end bearings which support a rotor shaft with its axis parallel to but offset from the axis of the liner. Vanes or blades slide radially in and out in slots through the shaft to define pockets which expand and contract with each shaft revolution.

Axial positioning and sealing of the ends of the vanes or blades of prior art pumps have been accomplished in different ways, each with accompanying advantages and disadvantages. One technique permits maximum volumetric efficiency but limits design and construction flexibility, whereas another technique has reduced volumetric efficiency but enhanced design flexibility. In this context, volumetric efficiency is increased when the rotor shaft is mounted as nearly tangent to the liner bore as practically possible. Also, mechanical integrity is enhanced when multiple pump units are mounted on a single rotor shaft.

The first of these prior art techniques involves the provision of stepped journals on the rotor shaft at opposite ends of the liner. This permits the end bearings that are mounted on the shaft journals to overlap radially the shaft outer diameter surrounded by the liner (hereinafter sometimes referred to as the "rotor barrel"), thus serving to position the vanes or blades axially even when the innermost retracted position of the blade tips substantially corresponds to the outer diameter of the rotor barrel. However, this design prohibits more than one pump unit per shaft because the end bearings for the pump unit must be assembled from opposite ends of the shaft. Accordingly, to provide a multiple pump unit utilizing this design requires interconnecting the shafts of a plurality of individual pump units using various types of drive couplings, thereby compromising the mechanical integrity of the pump design and increasing the overall cost.

Another prior art technique for axial positioning of vanes or blades in this type of pump utilizes a shaft of uniform diameter which permits multiple pump units to be mounted on a single shaft. However, this is accomplished at the expense of volumetric efficiency, in that in order to position the vanes or blades axially when the blade tips are at their innermost retracted positions, the rotor barrel is mounted short of tangent to the liner bore. Thus, the blade tips never retract completely, leaving as a minimum a small amount of the end faces of each blade projecting radially outwardly beyond the outer diameter of the rotor barrel which bear against a respective end bearing to position the blades axially. Because the rotor barrel is not tangent to the liner bore, the blades never retract completely into the barrel, whereby volumetric efficiency is reduced.

Still another prior art technique which permits multiple pump units to be mounted on a single shaft is disclosed in U.S. Pat. No. 4,619,594. In this patent, which is assigned to the same assignee as the present application and is incorporated herein by reference, the axial positioning of the blades (vanes) is accomplished by providing each blade with a radially extending tab at one axial end thereof. The tabs fit in an annular groove formed either by a counterbore in each pump liner or by a separate wafer at one end of each pump liner having an internal diameter that is greater than the liner internal diameter. While the volumetric efficiency of this pump design is greater than the prior art technique of mounting the rotor barrel short of tangent to the liner bore, it still lacks the volumetric efficiency of the single pump unit per shaft design previously described because of the small volume of fluid, termed the carryover volume, in the pockets in the counterbore between the tabs which in effect is never expelled from the pump.

SUMMARY OF THE INVENTION

With the foregoing in mind, it is a principal object of this invention to provide a single shaft, multiple pump unit vane type positive displacement pump without compromising the efficiency of any of the pump units or the mechanical integrity of the overall pump design.

These and other objects of the present invention may be achieved by providing three separate vane type pump units on a single rotor shaft, with spacers between the middle pump unit and both end pump units, and each pump unit sized such that the running clearance between the respective rotor barrels and surrounding cavities is substantially the same as for current conventional single pump unit per shaft designs.

In accordance with one aspect of the invention, the journal size of the middle pump unit on which the spacers are mounted is used to determine the outer diameter of the rotor barrels for the two end pump units.

In accordance with another aspect of the invention, the innermost retracted position of the blades of the end pump units substantially corresponds to the inner diameter of the spacers between the middle and end pump units. To prevent possible interference of the blades with the spacers in the event that the blades protrude into the spacer inner diameters in the extreme tolerance stack-up condition, the inner diameters of the spacers are desirably chamfered to guide the blade tips smoothly out from within the spacer inner diameters during outward movement of the blades beyond their innermost retracted positions.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DESCRIPTION OF THE PREFERRED EMBODIMENT

Figure 1:
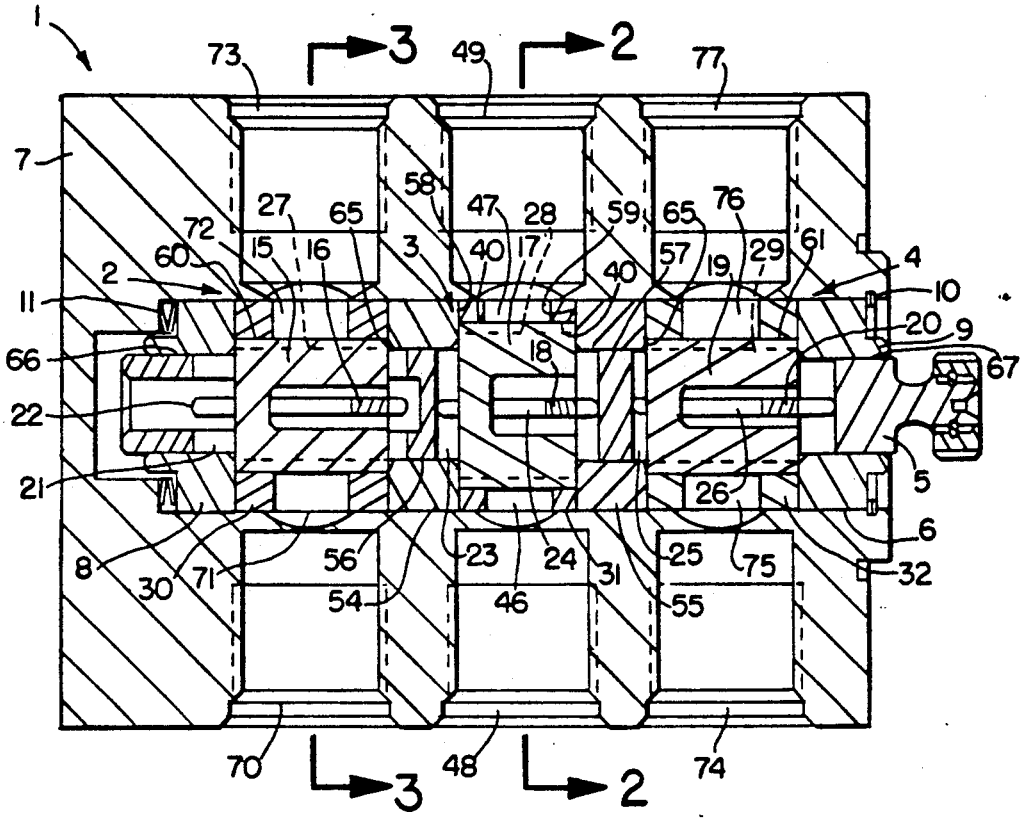
FIG. 1 is a longitudinal section through a preferred form of vane type positive displacement pump in accordance with this invention.

Referring now in detail to the drawings, and initially to FIG. 1, there is shown a preferred form of positive displacement pump 1 in accordance with this invention including three vane type pump units 2, 3 and 4 which share a common rotor shaft 5. The shaft 5 is mounted for rotation within a cylindrical bore 6 in a pump housing 7 as by means of a pair of sleeve bearings 8, 9 at opposite ends of the shaft. At one end of the bore 6 is a retaining ring 10 to retain the various parts in assembled relation, whereas at the other end of the bore is a spring tension washer 11 that provides a desired preload on the various pump parts to maintain the desired fluid seal therebetween.

Figure 4:
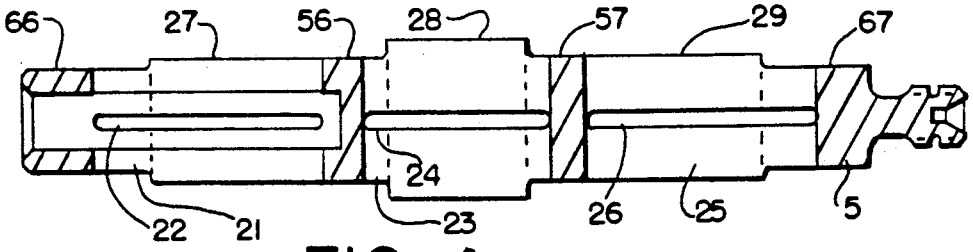
FIG. 4 is an enlarged longitudinal section showing the rotor shaft portion of the pump of FIG. 1.

Each of the pump units 2 through 4 includes its own set of vanes or blades 15, 16; 17, 18 and 19, 20 which extend through respective slots 21, 22; 23, 24 and 25, 26 in longitudinally spaced barrel portions 27, 28 and 29 of the rotor shaft 5. Surrounding the barrel portions 27, 28 and 29 are respective liners 30, 31 and 32. The respective slots 21 through 26 and barrel portions 27 through 29 can best be seen in FIG. 4, which is a longitudinal section showing the rotor shaft 5 by itself.

Figure 2:
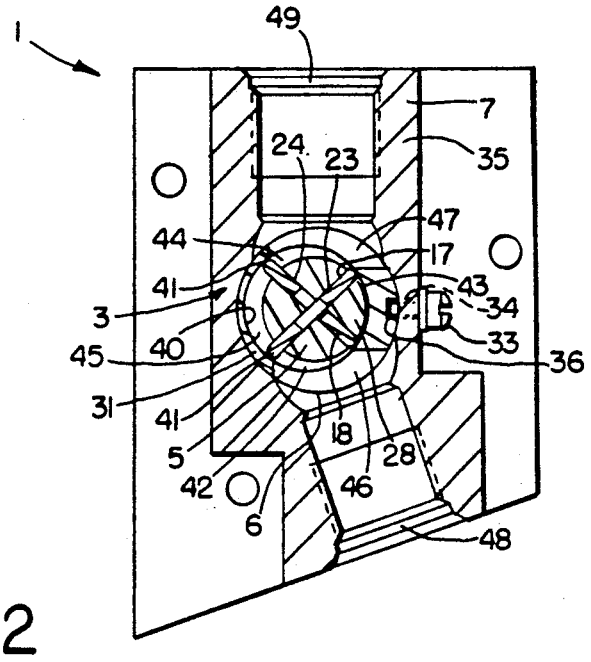
FIGS. 2 and 3 are reduced transverse sections through the pump of FIG. 1, taken generally along the lines 2—2 and 3—3 thereof.
Figure 3:
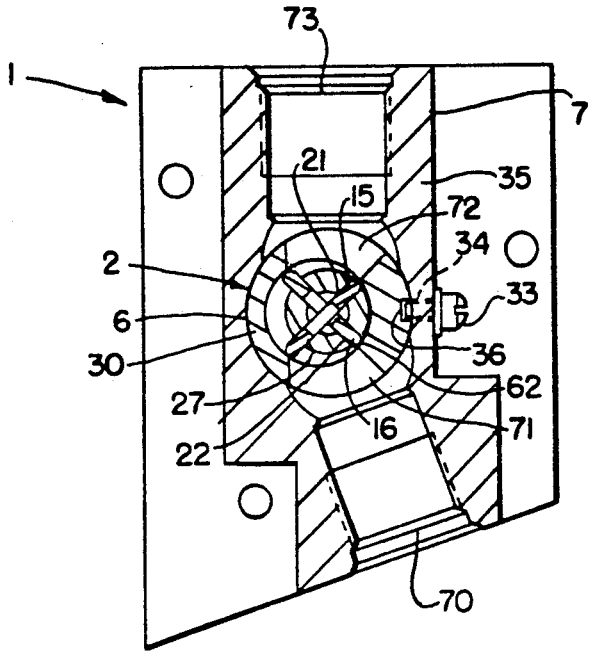

Each liner 30, 31 and 32 may be retained within the housing bore 6 as by means of a set screw 33 extending through a bore 34 in the housing wall 35 into an external recess 36 in each of the liners as schematically shown in FIGS. 2 and 3.

In the preferred embodiment disclosed herein, two mutually perpendicular slots 21, 22; 23, 24 and 25, 26 extend longitudinally through each barrel portion 27, 28 and 29 for receipt of two pairs of blades 15, 16; 17, 18 and 19, 20. Also, each pair of blades 15, 16; 17, 18 and 19, 20 may be formed as a single unit in a generally C-shape, with each pair facing in opposite directions in the respective slots as shown, or formed separately as desired.

The size of the middle pump unit 3 is desirably selected using a conventional single pump unit per shaft design and standard journal size for that particular pump unit. Also, the liner 31 for the middle pump unit 3 has an eccentric bore 40 whose axis is parallel to but offset with respect to the axis of the rotor shaft 5 as shown in FIG. 2, with the rotor barrel portion 28 as nearly tangent to the liner bore 40 as is practicable. Any clearance that does exist between the rotor barrel portion 28 and liner bore 40 is due to machining tolerances on the rotor shaft 5 and liner 31.

As in prior art pump designs, the blade tips 41 for the middle pump unit 3 engage the liner bore 40 to define pockets 42 through 45 which expand and contract as the rotor shaft 5 rotates. As the pockets move past the liner passages 46, 47 and associated ports 48, 49 in the pump housing 7, fluid is drawn in from one port and expelled out through the other port. Assuming the rotor shaft 5 is rotated in a clockwise direction as viewed in FIG. 2, the fluid will enter pump unit 3 through the port 48 and associated liner passage 46 and will be discharged from the pump under pressure through the liner passage 47 and associated housing port 49. Rotation of the rotor shaft 5 in the opposite direction will cause a reverse flow of fluid through the pump 3. Each of the other pump units 2, 4 operates in a similar manner.

The rotor slots 21 through 26 for the respective pump units 2 through 4 are axially longer than the respective blades 15 through 20 which are substantially the same length as the respective liners 30 through 32. The middle pump unit 3 is separated from the two end pump units 3, 4 by spacers 54, 55 which are mounted on the rotor shaft 5 adjacent opposite ends of the barrel portion 28 of the middle pump unit 3 preferably using the standard journal size for that particular pump unit. To that end, the outer diameters of the journals 56, 57 for the two spacers 54, 55 are somewhat less than the outer diameter of the middle pump unit barrel portion 28 whereby the opposed end faces 58, 59 of the spacers 54, 55 radially overlap opposite ends of both the liner 31 and barrel portion 28, thus serving to position the blades 17, 18 axially within the slots 23, 24 even when the blades 17, 18 are in their radial innermost retracted positions.

The blades 15, 16 and 19, 20 of the respective end pump units 2, 4 are positioned axially within the respective slots 21, 22 and 25, 26 (which are longer than the blades) by the spacers 54, 55 at one end and the end bearings 8, 9 at the opposite end. The barrel diameters 27, 29 for the two end pump units 2, 4 are made to correspond to the journal diameters 56, 57 for the middle pump unit 3. Also, the liners 30, 32 for the two end pump units 2, 4 are sized such that the running clearance between the respective barrel portions 27, 29 and liner bores 60, 61 is substantially the same as for current conventional single pump unit per shaft designs, whereby the efficiency of the two end pump units 2, 4, like that of the middle pump unit 3, may be substantially the same as for current conventional single pump unit per shaft designs.

In such a pump construction, the travel of the blades 15, 16 and 19, 20 in the respective liner bores 60, 61 of the two end pump units 2, 4, which are substantially identical, is such that the innermost retracted position of the blade tips 62 of the end pump units is very close to the inner diameter of the spacers 54, 55 (see FIGS. 1 and 3). In the extreme tolerance stack-up condition, it is feasible that the blades 15, 16 and 19, 20 will protrude into the spacer inner diameters, causing interference. To avoid this, special chamfers 65 are desirably provided on the inner diameters of the spacers 54, 55 on the ends facing the end pump units 2, 4 to guide the blade tips 62 out smoothly during outward movement of the blades 15, 16 and 19, 20 beyond their innermost retracted positions.

Figure 5:
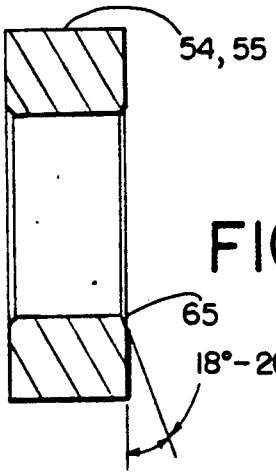
FIG. 5 is a further enlarged longitudinal section showing one of the spacers of the pump of FIG. 1.

If desired, the chamfers 65 on the spacers 54, 55 need only be provided in the regions of the innermost retracted positions of the blades 15, 16 and 19, 20 for the end pump units 2, 4. However, for reasons of economy, the chamfers 65 desirably extend all the way around the spacers at an angle of approximately 18° to 20° as measured from the end face of the spacers (see FIG. 5). Also, the height of the chamfers 65 is desirably kept to a minimum size of between approximately 0.020 inch and 0.060 inch to restrict internal leakage.

The diameter of the journals 66, 67 for the two end bearings 8, 9 is also preferably sized using the standard journal size for the two end pump units 2, 4, which is somewhat less than the barrel 27, 29 diameter for the two end pump units 2, 4 so that the end bearings 8, 9 serve to position the adjacent ends of the blades 15, 16 and 19, 20 within the slots 21, 22 and 25, 26 even when the blades are in the radial innermost retracted positions. Moreover, the opposed ends of the end bearings 8, 9 as well as that of the spacers 54, 55 may be chamfered to accommodate inside corner radius on the rotor shaft 5.

As previously indicated, the two end pump units 2, 4 operate in substantially the same manner as the middle pump unit 3. That is, assuming as before that the shaft 5 is rotated in a clockwise direction as viewed in FIG. 3, fluid will enter pump unit 2 through housing port 70 and associated liner passage 71 and will be discharged from the pump under pressure through liner passage 72 and housing port 73. At the same time, fluid will enter pump unit 4 through housing port 74 and associated liner passage 75 and will be discharged from the pump under pressure through liner passage 76 and housing port 77 (see FIG. 1). Rotation of the shaft 5 in the opposite direction will cause a reverse flow through the two end pump units 2, 4.

From the foregoing, it will now be apparent that the positive displacement pump of the present invention incorporates three separate pump units on a single rotor shaft without compromising the efficiency of any of the pump units or the mechanical integrity of the overall pump design.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

What is claimed is:

1. A vane type positive displacement pump comprising a housing, a shaft mounted for rotation in said housing, an intermediate vane type pump unit and two end vane type pump units mounted on said shaft in axially spaced relation with said intermediate pump unit located intermediate said end pump units, each said pump unit including a cavity in said housing having an axis parallel to and offset from the axis of said shaft and a set of vanes mounted in and radially slidable with respect to said shaft, said vanes engaging the wall of said cavity as said shaft rotates, and positioning means for positioning said vanes axially in said cavity, said positioning means including spacer means between said intermediate and end pump units, said shaft having reduced diameter journal portions adjacent opposite ends of said cavity for said intermediate pump unit on which said spacer means are mounted for axially positioning said vanes of said intermediate pump unit therebetween, said shaft including reduced diameter barrel portions for said end pump units which correspond in diameter to the diameter of said journal portions for said spacer means.

2. The pump of claim 1 wherein said shaft has a larger diameter barrel portion between said reduced diameter journal portions which is surrounded by a liner containing said cavity for said intermediate pump unit.

3. The pump of claim 2 wherein said larger diameter barrel portion is mounted substantially tangent to the wall of said cavity.

4. The pump of claim 2 wherein each of said spacer means radially overlaps said larger diameter barrel portion and said liner for said intermediate pump unit.

5. The pump of claim 2 wherein said vanes for said intermediate pump unit are received in longitudinal slots in said larger diameter barrel portion.

6. The pump of claim 5 wherein said slots are longer than said larger diameter barrel portion and said vanes contained in said slots whereby said spacer means serve to position said vanes axially within said slots.

7. The pump of claim 1 wherein said spacer means also axially position said vanes for said end pump units at one end of said cavities for said end pump units.

8. The pump of claim 7 wherein said positioning means also includes end bearings adjacent the other end of said cavities for said end pump units for axially positioning said vanes for said end pump units at said other end.

9. The pump of claim 8 wherein said shaft includes additional journal portions adjacent said other end of said cavities for said end pump units on which said end bearings are mounted.

10. The pump of claim 9 wherein the outer diameter of said additional journal portions is less than the outer diameter of said barrel portions for said end pump units.

11. The pump of claim 1 wherein said barrel portions for said end pump units are surrounded by additional liners containing said cavities for said end pump units.

12. The pump of claim 11 wherein said barrel portions for said end pump units are mounted substantially tangent to the wall of said cavities for said end pump units.

13. The pump of claim 12 wherein said end bearings radially overlap said barrel portions and liners for said end pump units.

14. The pump of claim 12 wherein said vanes for said end pump units are received in longitudinal slots in said barrel portions for said end pump units.

15. The pump of claim 14 wherein said slots in said barrel portions for said end pump units are longer than said vanes for said end pump units whereby said spacer means and said end bearings serve to position said vanes for said end pump units axially within said slots for said end pump units.

16. The pump of claim 7 wherein said barrel portions for said end pump units are mounted substantially tangent to the wall of said cavities for said end pump units, and the inner diameter of said spacer means have chamfer means on the ends facing said end pump units to guide said vanes for said end pump units smoothly out from within said inner diameters of said spacer means during outward movement of said vanes for said end pump units in the event said vanes for said end pump units should protrude into said inner diameters of said spacer means when in their innermost retracted positions.

17. The pump of claim 16 wherein said chamfer means extend all the way around the inner diameters of said spacer means.

18. The pump of claim 17 wherein said chamfer means extend at an angle of approximately 18° to 20° as measured from said ends of said spacer means facing said end pump units.

19. The pump of claim 18 wherein said chamfer means have a height of between approximately 0.020 inch and 0.060 inch to restrict internal leakage.

20. The pump of claim 16 wherein the inner diameter of the other ends of said spacer means have additional chamfer means to facilitate assembly of said spacer means onto said shaft.

21. A vane type positive displacement pump comprising a housing, a shaft mounted for rotation in said housing, an intermediate vane type pump unit and two end vane type pump units mounted in axially spaced relation on said shaft with said end pump units located adjacent opposite ends of said intermediate pump unit, each of said pump units including a liner in said housing having a bore with an axis parallel to and offset from the axis of said shaft, a barrel portion on said shaft surrounded by said liner, a set of vanes mounted in and radially slidable with respect to said barrel portion, said vanes engaging said bore in said liner as said shaft rotates, and spacer means between said intermediate and end pump units for axially positioning said vanes for said intermediate pump unit at both ends of said liner for said intermediate pump unit and for axially positioning said vanes for said end pump units at one end of said liners for said end pump units, said shaft having reduced diameter journal portions adjacent opposite ends of said barrel portion for said intermediate pump unit on which said spacer means are mounted, the outer diameter of said barrel portions for said end pump units corresponding to the outer diameter of said journal portions for said spacer means.

22. The pump of claim 21 further comprising end bearings adjacent the other end of said liners for said end pump units for axially positioning said vanes for said end pump units at said other ends.

23. The pump of claim 22 wherein said shaft includes additional journal portions adjacent said other ends of said liners for said end pump units on which said end bearings are mounted, the outer diameter of said additional journal portions being less than the outer diameter of said barrel portions for said end pump units.

24. The pump of claim 21 wherein said barrel portions for all of said pump units are mounted substantially tangent to the bores of the respective liners.

25. The pump of claim 24 wherein the inner diameter of said spacer means have chamfer means on the ends facing said end pump units to guide said vanes for said end pump units smoothly out from within said inner diameters of said spacer means during outward movement of said vanes for said end pump units in the event said vanes for said end pump units should protrude into said inner diameters of said spacer means when in their innermost retracted positions.

26. The pump of claim 25 wherein said chamfer means extend all the way around the inner diameter of said spacer means.

27. The pump of claim 26 wherein said chamfer means extend at an angle of approximately 18° to 20° as measured from said ends of said spacer means facing said end pump units.

28. The pump of claim 27 wherein said chamfer means have a height of between approximately 0.020 inch and 0.060 inch to restrict internal leakage.

29. A vane type positive displacement pump comprising a housing, a shaft mounted for rotation in said housing, an intermediate vane type pump unit and two end vane type pump units mounted on said shaft in axially spaced relation with said intermediate pump unit located intermediate said end pump units, each of said pump units including a cavity in said housing having an axis parallel to and offset from the axis of said shaft and a set of vanes mounted in and radially slidable with respect to said shaft, said vanes engaging the wall of said cavity as said shaft rotates, and positioning means for positioning said vanes axially in said cavity, said positioning means including spacer means between said intermediate and end pump units, said shaft having reduced diameter journal portions adjacent opposite ends of said cavity for said intermediate pump unit on which said spacer means are mounted for axially positioning said vanes of said intermediate pump unit therebetween and said vanes for said end pump units at one end of said cavities for said end pump units, the inner diameters of said spacer means having chamfer means on the ends facing said end pump units to guide said vanes for said end pump units smoothly out from within the inner diameters of said spacer means during outward movement of said vanes for said end pump units in the event said vanes for said end pump units should protrude into said inner diameters of said spacer means when in their innermost retracted positions.

30. The pump of claim 29 wherein said chamfer means extend all the way around the inner diameters of said spacer means.

31. The pump of claim 29 wherein said chamfer means extend at an angle of approximately 18° to 20° as measured from said ends of said spacer means facing said end pump units.

32. The pump of claim 31 wherein said chamfer means have a height of between approximately 0.020 inch and 0.060 inch to restrict internal leakage.

* * * * *